US008167277B2

(12) United States Patent
Satterfield

(10) Patent No.: US 8,167,277 B2
(45) Date of Patent: May 1, 2012

(54) FLUID SHEAR PROMOTION IN A CARBURETOR BOOSTER

(76) Inventor: John R. Satterfield, Poughkeepsie, NY (US)

( * ) Notice: Subject to any disclaimer, the term of this patent is extended or adjusted under 35 U.S.C. 154(b) by 381 days.

(21) Appl. No.: 12/574,620

(22) Filed: Oct. 6, 2009

(65) Prior Publication Data

US 2010/0090354 A1 Apr. 15, 2010

Related U.S. Application Data

(60) Provisional application No. 61/195,802, filed on Oct. 10, 2008.

(51) Int. Cl.
*F02M 19/10* (2006.01)

(52) U.S. Cl. ..... 261/23.2; 261/78.1; 261/DIG. 12; 261/DIG. 55; 261/DIG. 56

(58) Field of Classification Search ..... 261/23.2, 261/78.1, 78.2, DIG. 12, DIG. 55, DIG. 56; 239/8, 553, 567, 568
See application file for complete search history.

(56) References Cited

U.S. PATENT DOCUMENTS

| | | | | |
|---|---|---|---|---|
| 484,721 | A | 10/1892 | Parris | |
| 656,409 | A | 8/1900 | Laraway et al. | |
| 797,615 | A | 8/1905 | Schmitt | |
| 1,041,480 | A | 10/1912 | Kaley | |
| 1,144,342 | A | 6/1915 | Andrews | |
| 1,822,888 | A | 9/1931 | Haysel | |
| 1,969,960 | A | 8/1934 | Blum | |
| 1,985,165 | A | 12/1934 | Hapgood | |
| 1,994,766 | A | 3/1935 | Hagler | |
| 2,029,556 | A | 2/1936 | Brown | |
| 2,034,430 | A | 3/1936 | Farrow | |
| 2,118,220 | A | 5/1938 | Mock | |
| 2,525,083 | A | 10/1950 | Stresen-Reuter | |
| 2,985,524 | A | 5/1961 | Jocobus | |
| 3,245,666 | A | 4/1966 | Marsee | |
| 3,330,773 | A | 7/1967 | De Hart, Jr. | |
| 3,429,676 | A | 2/1969 | Galza | |
| 3,539,157 | A * | 11/1970 | Fort | 261/34.1 |
| 3,685,808 | A | 8/1972 | Bodai | |
| 3,756,580 | A | 9/1973 | Dunn | |
| 3,848,858 | A | 11/1974 | Page et al. | |
| 3,962,381 | A | 6/1976 | Farrish et al. | |
| 3,965,221 | A * | 6/1976 | Englert et al. | 261/23.2 |
| 4,049,758 | A * | 9/1977 | Englert et al. | 261/62 |
| 4,174,361 | A * | 11/1979 | Rollins | 261/41.4 |
| 4,206,158 | A | 6/1980 | Wood | |
| 4,217,313 | A | 8/1980 | Dmitrievsky | |

(Continued)

FOREIGN PATENT DOCUMENTS

DE 3716039 A1 * 12/1987

(Continued)

OTHER PUBLICATIONS

Emanual, Dave, "Super Tuning and Modifying Holley Carburetors," S-A Design Books, E. Brea CA, 1987.

(Continued)

*Primary Examiner* — Richard L Chiesa
(74) *Attorney, Agent, or Firm* — Douglas W. Rudy

(57) ABSTRACT

A carburetor booster that produces a shear factor to maintain emulsification of fluid passing through, out of, and around the booster body. The booster includes ports between a groove at a bottom portion of the booster and a plenum in the booster, the plenum being a source of a fuel mixture.

9 Claims, 3 Drawing Sheets

U.S. PATENT DOCUMENTS

| | | | | |
|---|---|---|---|---|
| 4,308,835 | A | 1/1982 | Abbey | |
| 4,387,685 | A | 6/1983 | Abbey | |
| 4,518,540 | A | 5/1985 | Takayasu | |
| 4,673,536 | A * | 6/1987 | Morris | 261/78.1 |
| 5,287,828 | A * | 2/1994 | Kennedy | 123/590 |
| 5,472,645 | A | 12/1995 | Rock et al. | |
| 4,387,685 | A | 2/1998 | Abbey | |
| 5,807,512 | A * | 9/1998 | Grant | 261/23.2 |
| 5,827,455 | A | 10/1998 | Nakai | |
| 5,863,470 | A | 1/1999 | Grant | |
| 6,120,007 | A * | 9/2000 | Grant | 261/23.2 |
| 6,211,251 | B1 | 4/2001 | Satterfield | |
| 6,281,253 | B1 | 8/2001 | Satterfield | |
| 6,478,288 | B1 * | 11/2002 | Duncan | 261/23.2 |
| 6,540,210 | B2 | 4/2003 | Satterfield | |
| 6,851,663 | B2 | 2/2005 | Satterfield | |
| 7,090,203 | B2 * | 8/2006 | Goto | 261/22 |
| 7,264,224 | B1 * | 9/2007 | Weston | 251/298 |
| 7,410,152 | B2 * | 8/2008 | Yates | 261/23.2 |
| 2005/0110170 | A1 * | 5/2005 | Grant | 261/23.2 |
| 2007/0074452 | A1 * | 4/2007 | Yates | 48/144 |
| 2008/0302326 | A1 * | 12/2008 | Grant | 123/184.46 |

FOREIGN PATENT DOCUMENTS

| | | |
|---|---|---|
| IT | 436484 | 12/1947 |
| JP | 55-75558 A | 6/1980 |
| JP | 57-193762 | 6/1980 |
| JP | 57-193762 | 11/1988 |

OTHER PUBLICATIONS

Urich, Mike and Fisher, Bill, "Holley Carburetors and Manifolds," HP Books, (1976), pp. 16-54.

Walordy, Alex, "Carb Mods," Stock Car Racing, Feb. 1998, pp. 100-107.

Crouse, William H. and Anglin, Donald, "Automotive Mechanics," 1993, Tenth Ed., McGraw Hill, Chapter 21, pp. 261-277.

Moxon, Julian, "How Jet Engines Are Made," 1985, Threshold Books Limited, pp. 1-32.

* cited by examiner

FLUID SHEAR PROMOTION IN A CARBURETOR BOOSTER

CROSS REFERENCE TO RELATED APPLICATIONS

This application is related to a provisional patent application filed Oct. 10, 2008 identified as Application No. 61/195,802, herein incorporated by reference in its entirety. This application claims the benefit of provisional patent application Ser. No. 61/195,802.

FEDERALLY SPONSORED RESEARCH

None.

SEQUENCE LISTING

None.

BACKGROUND

This invention is related to a system, apparatus and method for delivering a mixture of a combustible gas and air to an internal combustion engine through a carburetor. It is specifically directed to booster units used in the throats of carburetors. This booster will cause a stream of droplets of a fuel mixture to travel over a shear device to develop a stream or flow of smaller droplets thus providing increased combustibility of the fuel mixture.

The booster shape will provide for shear phenomena that will increase atomization of fuel being emitted from the booster as air flows through the throat of the carburetor. Each droplet of a fuel mixture is broken by the shear accomplished by the booster design presented herein into hundreds of smaller droplets. The booster also allows air flowing through the throat of a carburetor to cradle fuel droplets and thereby reduce manifold wetting.

The shape of the booster set forth in this specification, is configured to increase homogeneous emulsification of the fuel and air resulting in greatly increased engine efficiency.

Numerous references discuss the general subject of carburetor operation. See, for example, Super Tuning and Modifying Holley Carburetors, by Dave Emanuel (S-A Design Books, E. Brea, Calif., 1988), and Holley Carburetors, by Mike Urich and Bill Fisher (HP Books, Los Angeles, Calif., 1987). Both of those books are incorporated herein by reference. Neither of these publications discloses the improvements disclosed herein.

The above summary does not include an exhaustive list of all aspects of the present invention. Indeed, the inventor contemplates that his invention includes all systems and methods that can be practiced from all suitable combinations of the various aspects summarized above, as well as those disclosed in the detailed description below and particularly pointed out in the claims filed with the application. Such combinations have particular advantages not specifically recited in the above summary.

SUMMARY OF THE INVENTION

It is an object and advantage of this booster apparatus to reduce manifold wetting in a carburetor-equipped vehicle.

It is one object of this invention to provide a booster with a shear-inducing element at the point of exit of a fuel mixture from the booster.

It is an object of this invention to provide an improved fuel delivery device in carburetor-based systems by using a booster that enhances fuel separation from the booster fuel supply zone or surfaces.

It is an object of this invention to improve engine performance and fuel economy.

It is an object of this invention to provide combustion that is more efficient and diminish undesirable elements of the exhaust gas volume.

It is an object of this invention to reduce the emissions from engines by more thorough and efficient combustion of fuel.

It is also an object and advantage of this invention to increase booster performance over other styles of boosters.

It is also an object of the invention to provide a booster, or a plurality of boosters depending on the number of "barrels" in a particular carburetor, that can be installed in a conventional carburetor and increase the efficiency of the host carburetor.

The apparatus, methods and systems presented herein have application not only for internal combustion engines, but also other areas where increased carburetor response under acceleration is desired.

The aspects and applications of the invention presented here are described below in the drawings and detailed specification. Unless specifically noted, it is intended that the words and phrases in the specification and the claims be given the plain, ordinary and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition from that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term or phrase is intended to be further characterized or specified, or narrowed in some way, then such noun, term or phrase will expressly include additional adjectives, descriptive terms or other modifiers in accordance with the normal precepts of English grammar. Absent the use of such adjectives, descriptive terms or modifiers, it is the intent that the such nouns, terms or phrases be given their plain and ordinary English meaning to those skilled in the applicable arts as set forth above.

Further, the inventors are fully informed of the standards and application of the special provisions of 35 U.S.C. 112, Paragraph 6. Thus, the use of the words "function," "means" or "step" in the Detailed Description or Description of the Drawings or claims is not intended to somehow indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically and expressly state the exact phrases "means for" or "step for," and will also clearly recite "a function" (i.e., will state "means for performing the function of [insert function]"), without also reciting in such phrases any structure, material or act in support of the function. Thus, even when the claims recite a "means for performing the function of . . . " or "step for performing the function of . . . ", if the claims also recite any structure, material or acts in support of that means or step, or that perform the recited function, then it is the clear intention of the inventors not to invoke the provisions of 35 U.S.C.

112, Paragraph 6. Moreover, even if the provisions of 35 U.S.C. 112, Paragraph 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

DETAILED DESCRIPTION OF THE INVENTION

Figure 1:
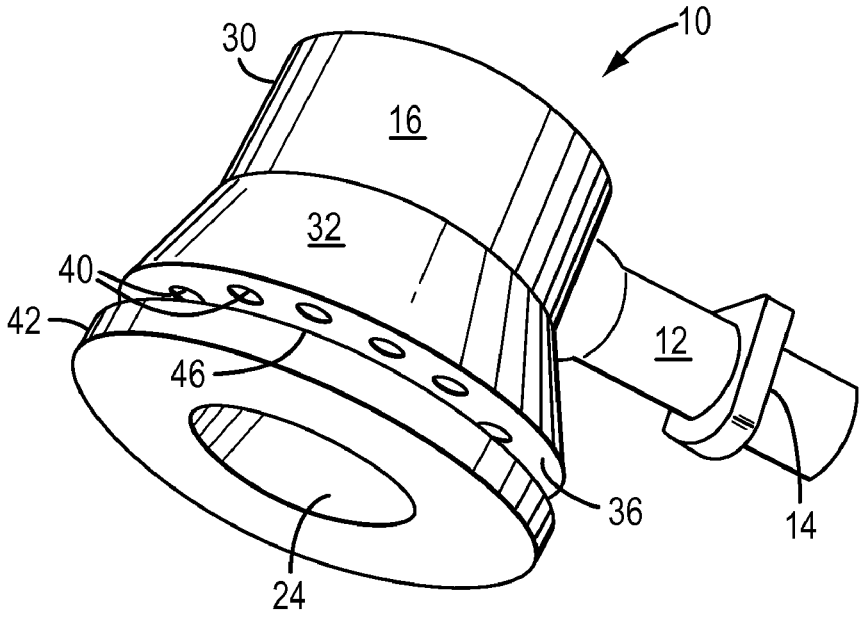
FIG. 1 is an orthographic projection from the lower side of the booster of the invention.
Figure 2:
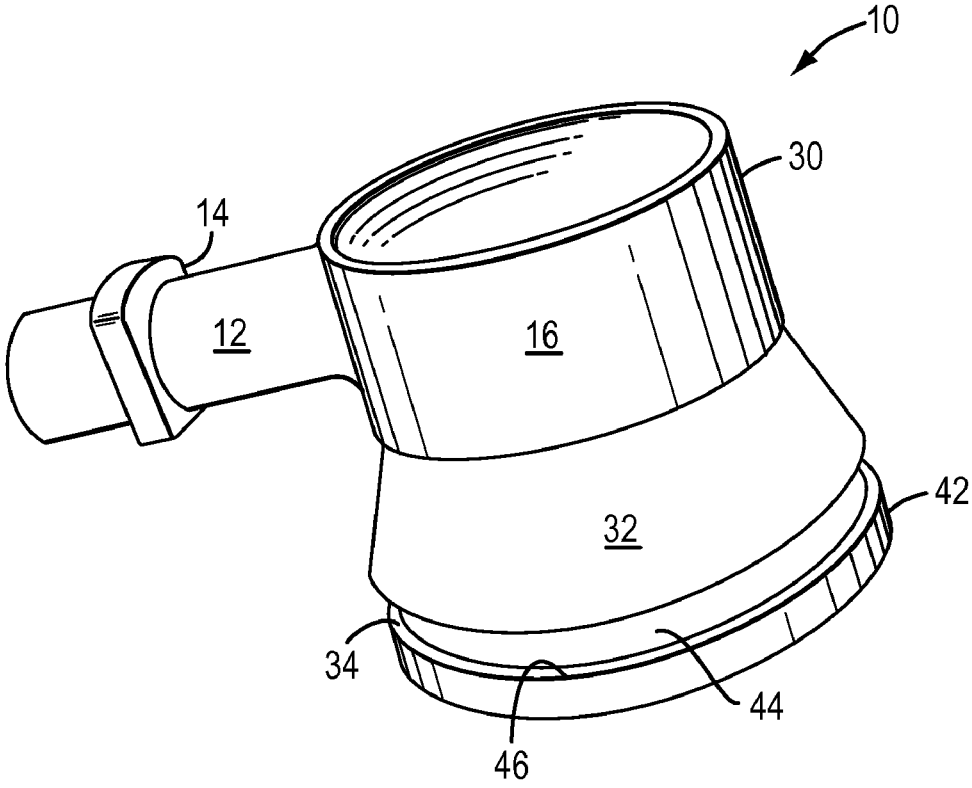
FIG. 2 is an orthographic projection from the top side of the booster shown in FIG. 1.

In FIGS. 1 and 2 a booster, generally 10, having the shear inducting structure or configuration of the invention is shown.

The booster, generally 10, includes hollow support 12 comprising a fuel delivery arm. The hollow support 12 is inserted as far as the stop 14, which will contact the sidewall of the barrel to prevent the hollow support from being inserted too far into the barrel and to support and locate the booster in the throat of a carburetor. A number of boosters corresponding to the number of throats or barrels of the carburetor will be positioned in each carburetor.

It is known to use boosters in the throats of carburetors however there are no boosters having the shape, particularly the exterior shape, of the booster disclosed herein. The mounting location of this booster in the throat of a carburetor is the same as the mounting location of normal boosters. However the booster presented herein may also be located higher or lower in the throat of a carburetor, relative to the narrowest portion of the carburetor throat, than is usually done.

Figure 3:
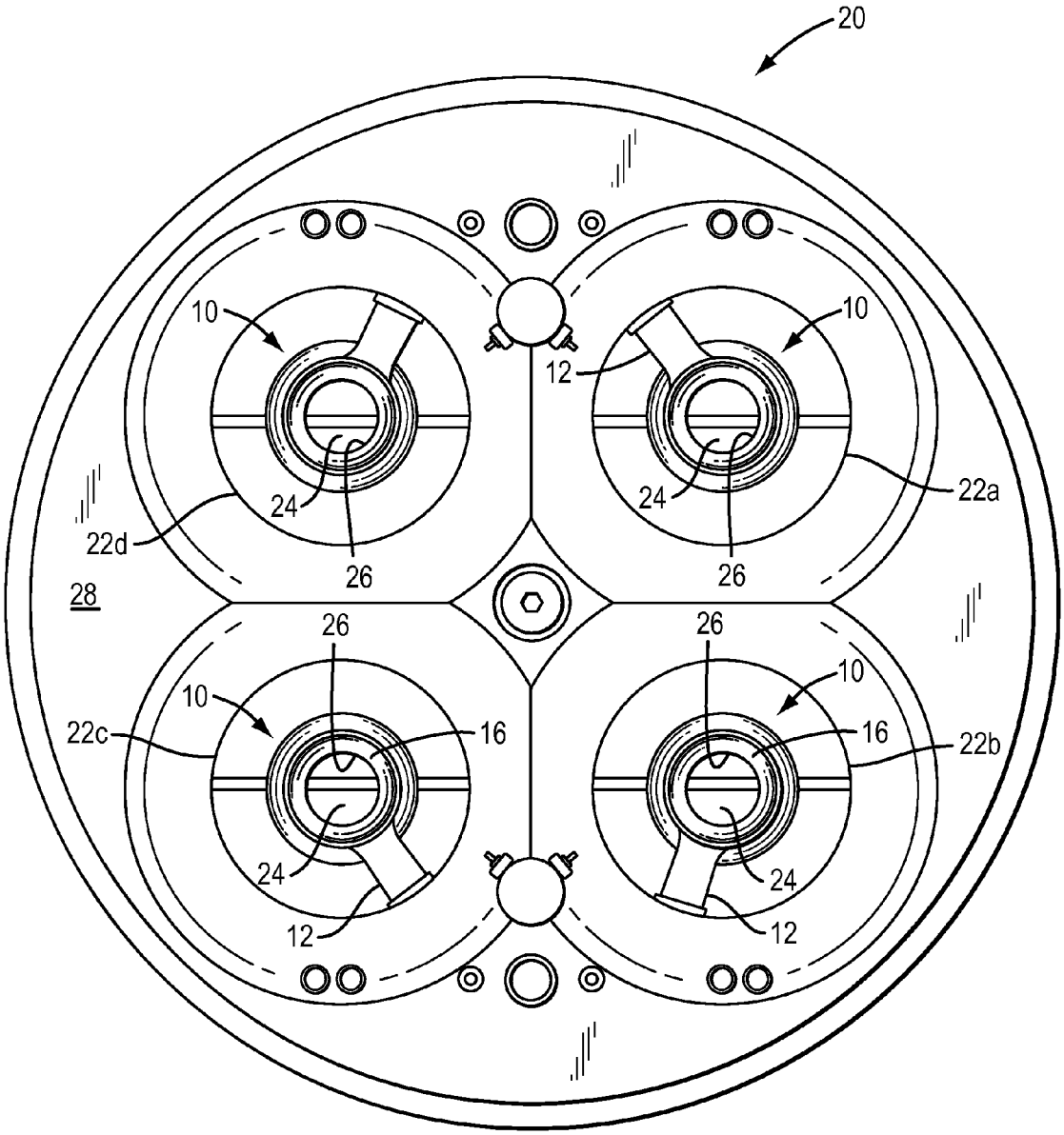
FIG. 3 is a top view of the body of a carburetor to show the location of the boosters in barrels of the carburetor.

FIG. 3 shows a top view of a carburetor generally 20. In this view it can be seen that there are four throats or barrels, 22*a-d*. The boosters, generally each shown as 10, are shown with one booster mounted in each carburetor throat. In this embodiment each booster will be the same size and configuration as each of the others however in another embodiment boosters of different dimensions, but including the same general shape and configuration will be used. In such alternative embodiments it may be beneficial to have two boosters of one size serving the primary throats and two boosters of a second size serving the secondary throats of the carburetor.

Returning to FIGS. 1 and 2, the booster arm or hollow support 12 is connected to a body portion 16. The body portion of the booster 16 has a through bore 24 passing through the body portion 16 of the booster 10. The through bore 24 may include a booster venturi section, not clearly seen in FIGS. 1 and 2 but shown as the narrowest portion 26 of the through bore 24 in FIG. 3 near the top portion 30 of the booster 10.

Fuel, in one embodiment a mixture of a volatile fluid and air, will flow into the booster 10 through the interior of the hollow support 12 from a supply port (not shown, but the port into which the booster is positioned leading to and from the interior of each of the throats of the carburetor as is well known. The supply port will, in most embodiments, connect with a main well of the carburetor. The main well may have an emulsion tube provision therein.

Figure 4:
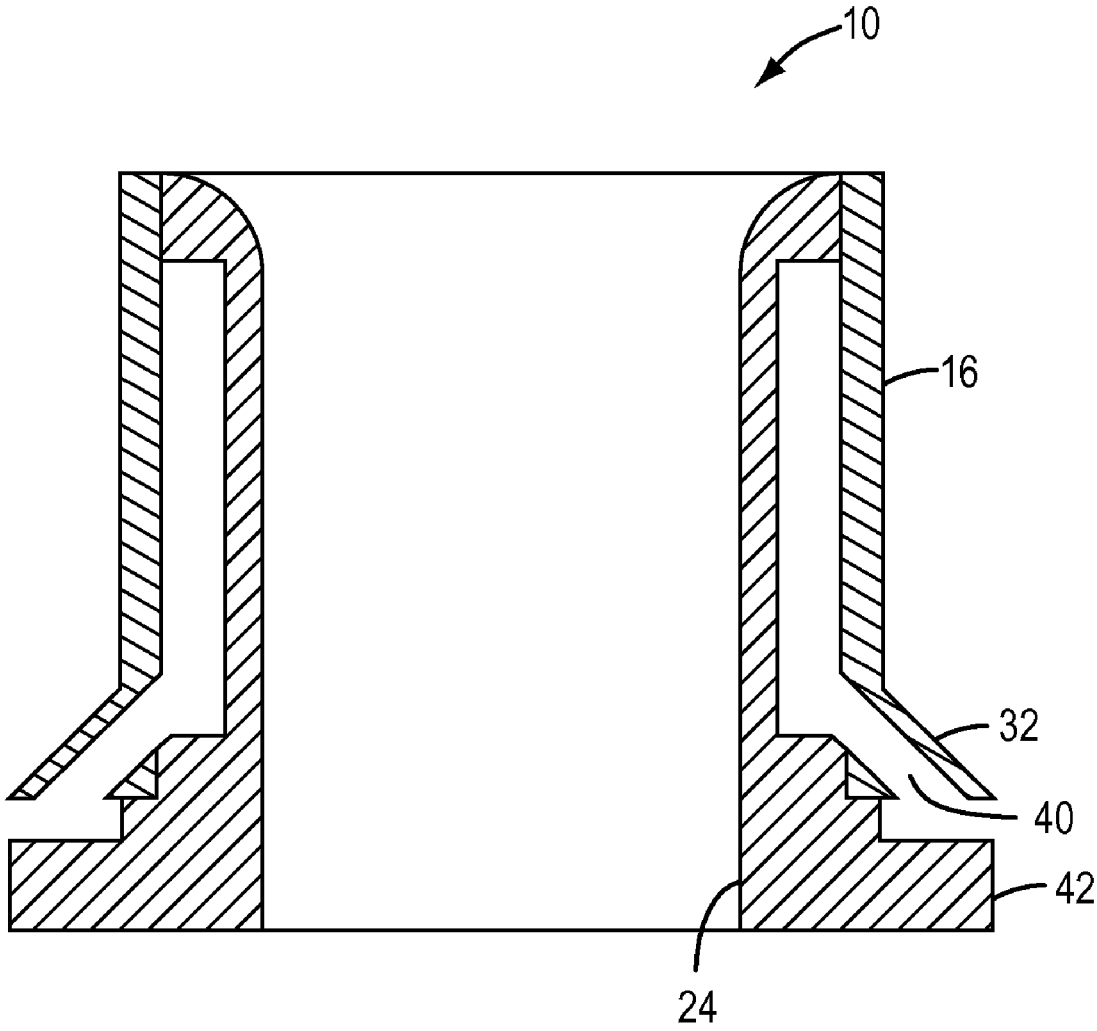
FIG. 4 is a pictorial cross section of a booster having a shear inducting configuration.

In a simple booster an emulsified fuel/air mixture is drawn through the booster by the low-pressure zone in the booster just below the booster venturi. It should be pointed out that in an alternative embodiment a booster bore may be a straight bore as shown in FIG. 4.

Looking again at FIGS. 1 and 2, a generally conical surface 32 is formed on the body of the booster 10 below the top portion 30 of the booster. This conical surface 32 terminates in a groove 34 that provides a circumferential groove around the circumference of the booster at the widest lower edge of the conical surface. The groove 34 will have a generally flat surface 36 into which a series of ports such as 40 are formed. There are many similar ports to the two ports identified as ports 40, formed in the upper surface of the groove 34, that is, in the flat surface 36 of the groove 34.

These ports 40 extend from the flat surface 36 to a fuel inlet source point, generally a plenum receiving a fuel/air mixture from the supply port on the carburetor body, at the inboard bore 24 near the top of the booster 10.

A flange 42 is provided below the groove 34 at the bottom of the conical section 32 with the upper surface of the flange defining the lower edge surface of the groove 34. The top section of the flange 42 is formed as a shallow cone, the surface of which is shown as surface 44 in FIG. 2, that defines the shape of the lower area of the groove 34. This flange 42 provides a "waterfall" or edge over which a fuel mixture will flow and the mixture flowing over the edge will be sheared from large drops of mixture into much smaller droplets. This shear effect on the droplets will cause a large drop of mixture to be sheared into many much smaller droplets of fuel mixture.

FIG. 4 is a representation of a booster in cross section provided to show the outlet ports 40 of the booster 10 connected to a fuel delivery passage that will receive fuel from the hollow support and its connection with a supply of fuel at the inlet port (hollow support not shown in this view). Note that the bore in the FIG. 4 embodiment doesn't show a venturi in the bore of the booster. This is just one embodiment of a booster and other embodiments may have a venturi section in the bore.

Back to FIGS. 1 and 2, in one embodiment the cross sectional shape of the groove will be like the letter "V" rotated ninety degrees. One leg of the "V" will be the flat surface 36 into which the ports 40 are formed and the second leg of the "V" will be the shallow conical section or surface 44 of the flange 42.

As mentioned above, the outlet ports 40 extend through the body portion of the booster (see FIG. 4 for example) beneath or inboard of the conical surface 32 to a location in the booster 10, generally near the top of the booster 10, that is a source of an emulsified fuel and air supply. This mixture of volatile liquid and air, comprising a combustible mixture, will flow through the ports 40 of the booster 10 and be discharged into the throat of the host carburetor to meet up with a mixture of fuel and air passing through the throat of the carburetor as it is in use on an engine. At this point in time, the carburetor, functioning as a fuel/air mixer and delivery device to an operating internal combustion engine, will also be flowing of a mixture of emulsified fuel/air flowing through the throats of the carburetor outboard of the external surface of the body of the booster 10.

The velocity of the mixture flowing through the booster 10 will be significantly high, due to the venturi effect of the flow through the bore 24 of the booster, and to some extent, the velocity of flow through the venturi of the throat of the carburetor in which the booster is located, (either at the narrowest point of the venturi, above the narrowest venturi point, or below the narrowest venturi point), such that as the mixture exits the ports 40 at least a portion of the mixture will interact with the relative sharp edge 46 of the groove 34. A portion of the mixture will be radically un-stabilized, the term "shear factor" may be used to describe this action, thus increasing the atomization of the mixture as it leaves the outlet ports of the booster 10.

To be most effective the shear-producing element, the flange for instance, should be perpendicular to the flow of fuel to be most effective.

The aerodynamic window, as seen from the airflow direction through the booster, from top to bottom thereof, in this version of a booster is small so as to cause a low pressure below the regular booster.

The flange 42 may have a circumference that is larger or smaller than the circumference of the surface 32 at the point where the ports 40 are located on the surface 36 forming the top surface of the groove 34. Also the flange 42 may be tapered to match the taper of the surface 32 or it may be flat or tapered to not match the termination edge circumference of the surface 32.

In another embodiment the flange surface may be formed as a wavy or rippled shear rather than a flat flange surface. Or, in another embodiment, the shear flange will have an upward turned edge on it. Further embodiments may have other forms of interruptions to cause shear. For instance, screens, holes in the shear flange or any other configuration to cause the fuel mixture to cascade over or through a surface and cause the fuel to shear initially from large droplets to much smaller droplets after the shear event are contemplated by the inventor.

In operation, with the booster 10 located in the throat of a carburetor, at, above or below the narrowest point of the venturi of the throat, there will be a "shear event" that is instigated by the unique structure of the booster 10. This shear event will have the effect of helping to keep the fuel/air emulsified mixture passing through the throat of the carburetor in a fine droplet or mist state that is very important in producing a charge to the cylinders of an internal combustion engine. By "shearing" the mixture passing through the throat of the carburetor in the area around and relatively outboard of the external surface of the booster 10, the mixture, as it passes over the external surface of booster 10, the host engine can deliver more economy, better combustion and higher horse power as compared to a engine carburetor combination that does not use the shear principle of this booster 10.

In summary, one embodiment of the invention is characterized as a booster for use in a throat of a carburetor. This booster has a body portion that includes a through bore and a hollow support in communication in an inlet port of the body portion, a portion of the body below the hollow support has a conically-shaped section flared outwardly from the top of the conically-shaped portion to a flat surface at the bottom of the conically-shaped portion of the body. A plurality of outlet ports extend from the flat surface at the bottom of the conically shaped section into an upper portion of the booster, and these outlet ports are in communication with the inlet port that is in communication with the hollow support carried in the body portion of the booster. In this configuration fluid supplied to the inlet port in communication with the hollow support will pass through the outlet ports at the bottom of the conically shaped portion of the body of the booster and interface, to create a shear event, with a flange connected to the bottom portion of the body portion of the booster. There will also be a groove formed between the surface at the bottom of the conically shaped section of the booster and the flange. This groove has a generally flat surface at the top of the groove forming the bottom of the conically shaped section of the body of the booster. In this embodiment a ramped surface having a shallow cone on the top surface of the flange provides a surface of the groove. Also in this embodiment fluid supplied to the inlet port in communication with the hollow support will pass through the outlet ports and be delivered to the groove location of the booster.

A slightly different edge configuration is shown in the FIG. 4 embodiment where the top surface of the flange is relatively flat rather than formed with a ramped surface as part of the groove.

In one embodiment of the invention a through bore of the body portion of the booster includes a through bore extending from the top portion of the booster to a bottom portion of the booster and a venturi may be positioned in the bore of the booster. The top portion of the booster may have a diameter less than the diameter of a bottom portion of the booster.

The use of outlet ports, in one embodiment, four or more outlet ports, terminating at the flat surface of the bottom of the conically shaped section of the body comprise a plurality of outlet ports.

These outlet ports each have a circumferential edge and the circumferential edge of each port is closer to the through bore of the booster than to the outboard edge of the conically shaped portion of the body.

In another embodiment the circumferential edge of each port is closer to the outboard edge of conically shaped portion of the body of the booster than to the through bore of the body of the booster.

Also in this embodiment there may be a stop on the hollow support. This stop locates the hollow support in the inlet port of the body portion of the booster.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim.

The invention claimed is:

1. A booster for use in a throat of a carburetor, the booster comprising:

a body portion;

a hollow support in communication with in an inlet port of the body portion of the booster;

the body portion having a conically-shaped section flared outwardly from the top of the conical shape to a surface at the bottom of the conical shape;

a flange connected to the bottom portion of the body portion;

a groove formed between the surface at the bottom of the conically-shaped section and the flange, the groove having a generally flat surface at the top of the groove forming the bottom of the conically-shaped section of the body of the booster;

a plurality of outlet ports extending upwardly from the flat surface of the groove into an upper portion of the booster, the outlet ports in communication with the inlet port in communication with the hollow support; and a ramped surface comprising a shallow cone on the top surface of the flange, the ramped surface providing a surface of the groove; whereby fluid supplied to the inlet port in communication with the hollow support will pass through the outlet ports and be delivered to the groove location of the booster.

2. The booster in accordance with claim 1 wherein the body portion of the booster comprises a through bore extending from the top portion of the booster to a bottom portion of the booster below a lower surface of the flange.

3. The booster in accordance with claim 2 wherein the bore comprises a venturi positioned in the bore of the booster.

4. The booster in accordance with claim 1 wherein the plurality of ports include more than four outlet ports.

5. The booster in accordance with claim 4 wherein the outlet ports comprise a circumferential edge and the circumferential edge of each outlet port is closer to the through bore of the booster than to the outboard edge of the conically-shaped section of the body.

6. The booster in accordance with claim 4 wherein the outlet ports comprise a circumferential edge and the circumferential edge of each port is closer to the outboard edge of the conically-shaped section of the body of the booster than to the through bore of the body of the booster.

7. The booster of claim 1 comprising a stop on the hollow support, the stop locating the hollow support in the inlet port of the body portion of the booster.

8. The booster in accordance with claim 2 comprising the top portion of the booster having a diameter less than the diameter of a bottom portion of the booster.

9. A method of improving the operation of a carburetor booster of a carburetor comprising the acts of:

providing a booster in the throat of the carburetor, the booster having a body section including a through bore, a hollow support in communication in an inlet port of the body portion, a portion of the body below the hollow support, the portion of the body having a conically-shaped section flared outwardly from the top of the conically-shaped section to a flat surface at the bottom of the conically-shaped section of the body, and a plurality of outlet ports extending from the flat surface at the bottom of the conically-shaped section into an upper portion of the booster, the outlet ports in communication with the inlet port in communication with the hollow support carried in the body portion of the booster;

supplying a fluid to the inlet port in communication with the hollow support whereby the fluid will pass through the outlet ports at the bottom of the conically-shaped section of the body of the booster.

* * * * *